United States Patent [19]

Kerfante

[11] 4,110,763

[45] Aug. 29, 1978

[54] CHARACTER HOLDER

[75] Inventor: René Kerfante, Dietzenbach-Steinberg, Fed. Rep. of Germany

[73] Assignee: Eltra Corporation, Toledo, Ohio

[21] Appl. No.: 791,078

[22] Filed: Apr. 26, 1977

[30] Foreign Application Priority Data

Apr. 29, 1976 [DE] Fed. Rep. of Germany ... 7613449[U]

[51] Int. Cl.[2] ..... B41B 15/06

[52] U.S. Cl. ..... 354/14; 354/5; 354/12

[58] Field of Search ..... 354/5, 12, 14, 15, 18; 352/78 R, 129

[56] References Cited

U.S. PATENT DOCUMENTS

| | | | |
|---|---|---|---|
| 3,291,015 | 12/1966 | Moyroud | 354/14 |
| 3,447,866 | 6/1969 | Heisler | 352/129 |
| 3,852,775 | 12/1974 | Cary et al. | 354/14 |
| 3,923,387 | 12/1975 | Skinner et al. | 352/78 R |

*Primary Examiner*—Russell E. Adams

*Attorney, Agent, or Firm*—Robert E. Greenstien

[57] ABSTRACT

A photocomposing machine having a cassette containing a continuous film tape loop. The loop rides on two rollers which stretch the loop when it is inserted on the photocomposing machine. The rollers are spool-shaped to avoid contact with the character containing portions of the tape. A lead plate, which is integral with the cassette, provides proper loop alignment and tension. The illuminating light from the photocomposing machine is directed through the tape and out of the cassette by means of a prism system that extends through the bottom of the cassette. The loop contains character identification and alignment markings which are illuminated through corresponding apertures in the lead plate.

10 Claims, 4 Drawing Figures

CHARACTER HOLDER

BACKGROUND OF THE INVENTION

This invention deals with character holders for photocomposing machines in which the characters are arranged on the holder by rows along with associated position markings.

Such character holders normally are formed on a round glass disc upon which the characters are positioned in arch-shaped rows. Corresponding to the letters, apertures are included which indicate the character size and determine the distance which they are to be set apart. A metallic stop element is located in the center of the disc, which is equipped with a handle for the manipulation of the disc, to adjust and lock the disc on photocomposing machine for operation.

This known character holder is especially disadvantageous in that the areas in which the characters are arranged are open to the environment and as a result could be touched accidentally by operating personnel, and especially when the disc is inserted or removed from the photocomposing machine. The spoilage which thus results, especially through fingerprints, frequently are not removed carefully prior to actual photocomposing, so that, very often the disturbing marks appear in the final print product, which can necessitate that the defective work be repeated. In addition, the round character holder is especially fragile if it is produced from a breakable material, such as glass.

The state-of-the-art also shows a character holder in which the letters are arranged on a film tape which is positioned around a drum (DT-PS No. 365,131). Specifically this drum is defined by a circle of tension bolts which are vertically standing on a drum disc, so that, an open sided drum is created. The drum can carry one, two or more film tape rows located side by side thereon.

Apart from the fact that this drum cannot be easily changed, the externally located film tape is thus greatly exposed, and one must consider the unintentional touching of the area which carries the characters. Furthermore, the continuous film tape that is looped around the drum can expand over the course of time so that a sharp character image is not guaranteed to be produced. Moreover, during the production of this character holder or during a possible exchange of film tapes onto the drum special care has to be taken so that the characters are produced thereon only in the area between the stretching bolts. This character holder, therefore, did not succeed in the industry.

Another character holder for photocomposing machines also consists of a character tape which can be wound and unwound between two drums (DT-PS No. 439,668).

This character holder also has the disadvantage in that the character tape can be easily soiled through unintentional touching, which cannot be easily corrected. In addition, one has to fear a deterioration of the print quality produced therefrom over a period of time because of the tape windings, which can shift with respect to each other on the drums and produce scratches.

The present invention therefore has an object to create character holders for a photocomposing machine in which the character holding parts are extensively protected against unintentional touching, and most of all by which all fingerprints can be avoided as well as marks, such as scratches. In total, the desired character holder should make it possible to obtain high print quality over a long period of time. Finally, the character holder should be easy to change.

SUMMARY OF THE INVENTION

The aforementioned objects for a character holder in which the characters are arranged in rows along with position markings is achieved by the present invention in that a continuous film tape is placed in a cassette and the tape is looped around two separately positional rotating rollers. The film tape is extensively protected in the cassette against unintentional touching when it is exchanged, so that, the occurrence of fingerprints on the tape is highly unlikely. As a result, the tape does not need to be cleaned frequently. Furthermore, the cassette quite effectively removes the film tape from the environment so that it need not be inserted within the housing of the photocomposing machine, but instead affixed from the outside onto an external portion of the machine. This results in considerable ease in servicing when changing the character style. Contained within the cassette are the aforesaid rollers which are positioned at a distance with respect to each other to lead the film tape and provide the drive to move the film tape, which does not have to press against the entire portion of each roller.

The character holder is made in a particularly manageable and adjustable form with the cassette being an extended or oblong box so that the film strip is basically parallel to the opposite sidewalls of the box. The cassette is completely closed with the exception of at least one opening in one of the sidewalls. As a result, the portions of the film tape that carry the characters are particularly well protected. The opening in one of the sidewalls is intended to permit a character on the film tape, which is located behind the opening, to be projected through the cassette wall.

The inclusion of a single opening is all that is necessary if the illuminating device is contained within the cassette. If the lighting equipment necessary for projection is not so located within the cassette, then the cassette is appropriately constructed to include an additional opening in the floor thereof. Through this additional opening a portion of the light from the illuminating source is directed by way of a light prism which extends into the cassette through the opening. The light source itself does not therefore have to be located in the cassette, which avoids heating the cassette and film tape. Moreover, the cassette can be light and compact. A feature of the present invention is that at least one of the rollers in the cassette is formed to include a coupling part accessible from the outside, which is coupled to a corresponding coupling part of the photocomposing machine to move the film tape. As a result, the drive element can be located outside of the cassette. Furthermore, the coupling through which the connection is established through the photocomposing machine can serve to adjust the rollers, to properly tension the film tape.

In connection with the latter feature, the character holder of the present invention is particularly advantageous in that it is constructed so that at least one reel of the cassette is loosely positioned therein so that the tape is relaxed or untensioned when the cassette is not affixed on the photocomposing machine. This avoids undesirable expansion of the film tape which can lead to increased slipage at the rollers and shifting of the tape from the desired optical plane which can produce print distortion.

A further and particularly noticeable feature of the present character holder consists in that the roller is equipped with an upper flange and lower flange, the upper flange being located opposite the upper wall of the cassette and the lower flange resting on the floor of the cassette, which contains a bore that is somewhat smaller then the diameter of the lower flange. The lower flange includes a disc-shaped part made of ferromagnetic material having a diameter that is also somewhat smaller then the diameter of the bore in the floor, and contained within the roller is a coaxial bore that extends through the disc-shaped part. It can be appreciated that in view of the achieved effect, the construction is relatively simple. That is, on one hand, a loose position of the roller is achieved, while on the other hand it is held securely in place when the cassette is in use.

A particularly noticeable feature of the rollers is that the core thereof next to the flanges for a larger diameter in the middle sections thereof. As a result, no scratches will be produced in the picture critical parts of the film, in the event that there is some slipage between the roller and the film tape when the tape is transported in the cassette.

For proper alignment, that is to adjust the character holder properly on the photocomposing machine the lower floor of the cassette is advantageously equipped with centering holes.

Still another feature of the character holder of the present invention is that a lead plate is included, which is parallel and in close proximity to the sidewall in which the first opening is found and which has at least one opening located opposite to the first opening in the sidewall. The film tape passes between the lead plate and the sidewall, and with this lead plate, the film tape is held securely in the proper optical plane to precisely reproduce the characters when the character holder is inserted in the photocomposing machine.

The character holder is suitably equipped so that the lead plate is equipped with oblong elevations on the side pointing to the immediately opposing sidewall. Those portions of the film tape which do not carry any characters or position marks slide across these elevations, and although the elevations provide a secure film lead and precise adjustment in the object optical plane, no scratches are created in the important parts of the film tape.

The present invention is described in detail with the aid of the following drawings.

DESCRIPTION OF THE DRAWINGS

In all of the foregoing figures the same parts are identified by the same numbers.

DETAILED DESCRIPTION

Figure 1:
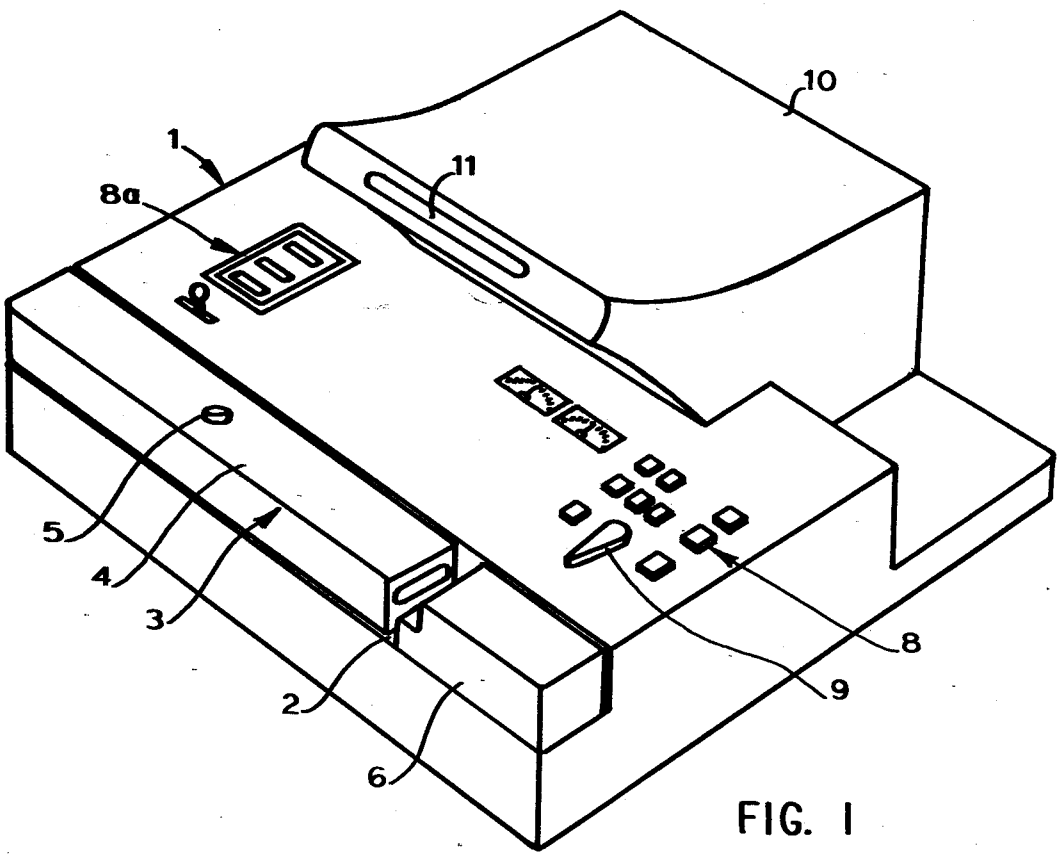
FIG. 1 shows a character holder cassette which is placed on a photocomposing machine.
Figure 4:
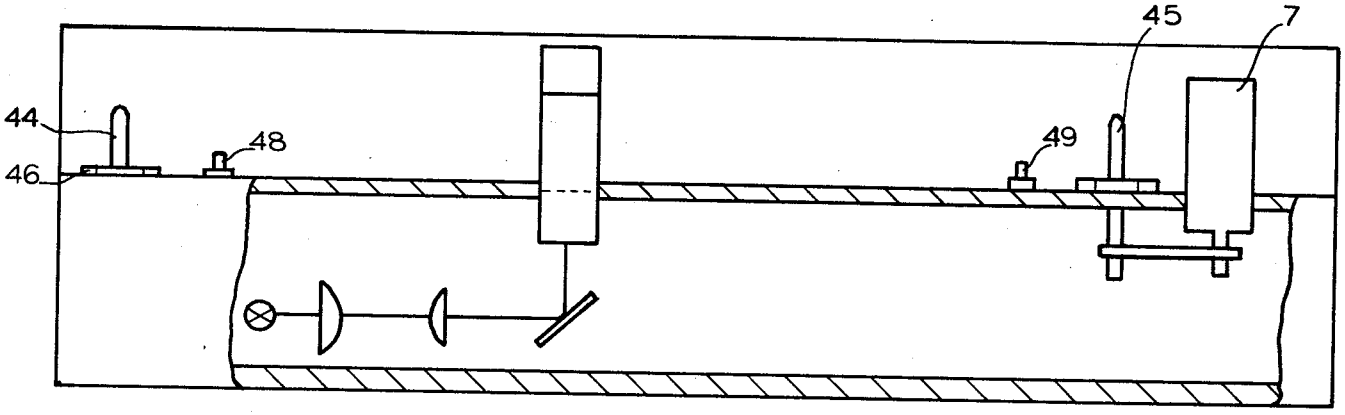
FIG. 4 shows a partial sectional view of the photocomposing machine as viewed from the front with the character holder cassette removed.

In FIG. 1, the photocomposing machine is identified generally as 1. It is essentially formed as a flat box like body. In the front portion of the machine a step like recess 2 is shown in which a character holder cassette 3 is inserted. Cassette 3 is formed as a oblong box that fills the recess 2. The cassette can be attached to the photocomposing machine through a lock screw 5 which reaches through the upper wall 4. In the smaller box 6, located adjacent to the cassette there are drive sources for the character control, particularly a servo motor 7, as shown in FIG. 4.

In FIG. 1, on the upper side of the photocomposing machine there are indicator and service elements identified as 8 and 8*a* and among which there is also a service element 9 for the selection of the desired character on the character holder. On the back part of the machine is a cover 10 with an observation slit 11 through which the characters can be observed on a phosphorescent tape.

Figure 2:
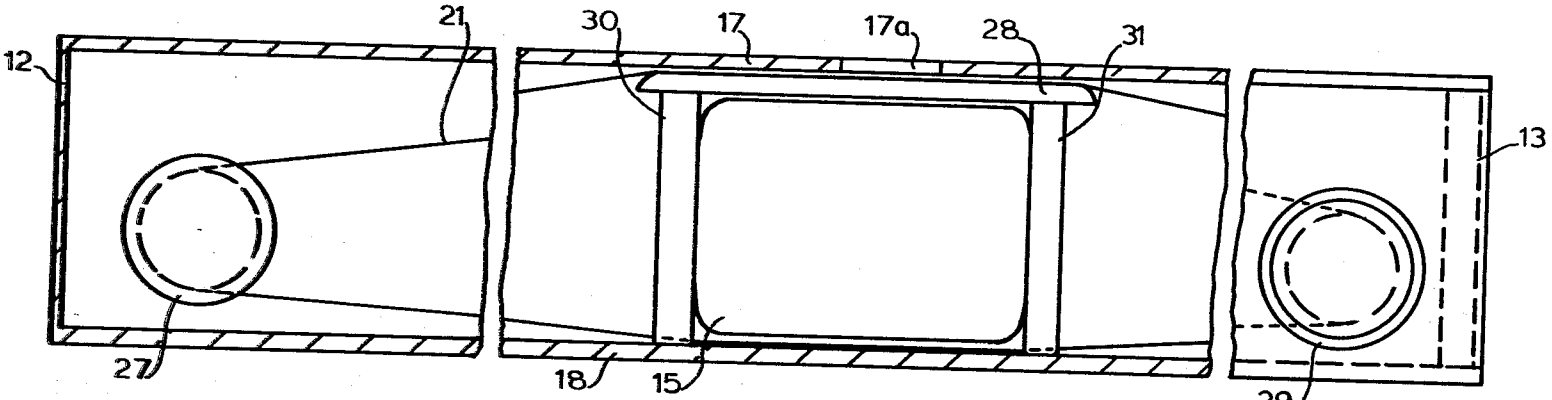
FIG. 2 shows a cross sectional view of the character holder cassette.
Figure 3:
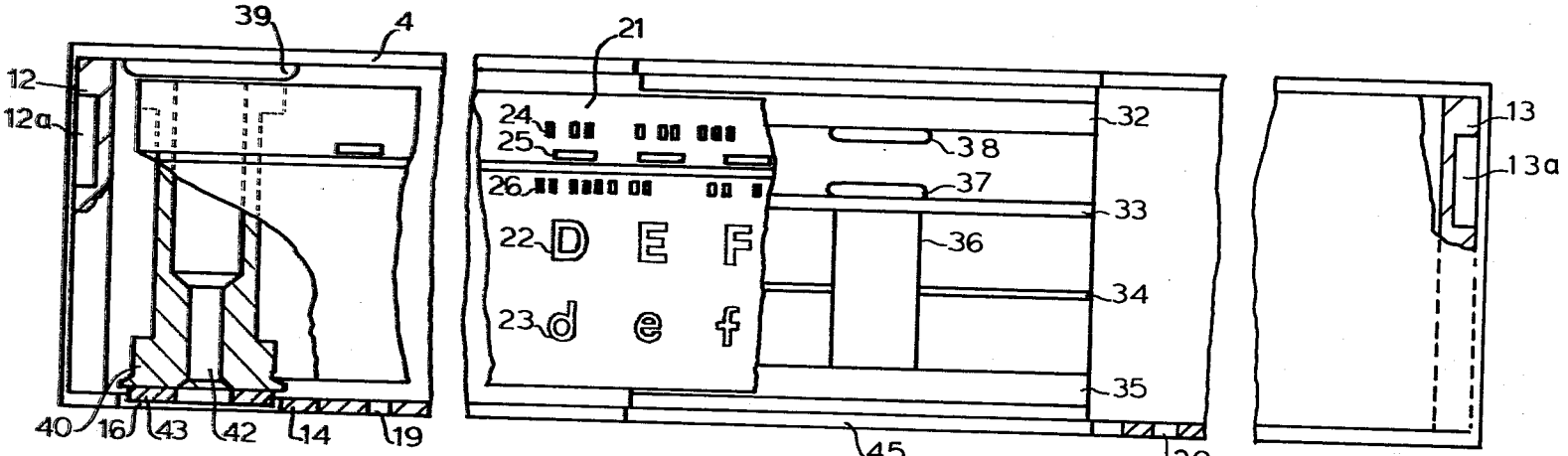
FIG. 3 shows a partial section of the character holder cassette as viewed from the front thereof.

In FIGS. 2 and 3, the character holder cassette that is insertable and exchangeable on the typesetting machine is shown in more detail. The character holding cassette is formed as noted as an oblong box with three pairs of oppositely located and equally large walls. The left and right frontal sides are designated by numbers 12 and 13. Both frontal sides are equipped with light proof indentations 12*a*, 13*a* for easy handling. The upper wall 4 is closed while the wall 14 located there below includes an opening 15 as well as left and right thereof one bore each. Only bore 16 is recognizable in FIG. 3. Furthermore, the character holder cassette has a forward sidewall 17, which when the cassette is placed on the photocomposing machine points to the machine. Located opposite sidewall 17 is sidewall 18. Sidewall 17 is equipped with an opening 17*a* that corresponds to an opening in the photocomposing machine. For the purposes of completeness, it is also mentioned that the floor 14 includes central holes 19 and 20 for proper alignment of the cassette on the photocomposing machine.

The cassette that is structured with these walls contains a continuous film tape 21 that contains two rows of characters 22, 23 in addition to three rows of position markings 24, 25, and 26. The position marking rows 24 and 26 correspond to the size of the characters arranged thereunder, whereas the markings of row 25 serve to adjust and focus in the film tape in the desired position necessary to copy the character.

The continuous film tape is lead by a roller 27 across a lead plate 28 to a second roller 29 and returns from there again to roller 27. The lead plate 28 is arranged in close proximity and parallel to the forward sidewall 17, and is attached to the oppositely located backwall 18 by bolts 30 and 31 which are visible in FIG. 2. The lead plate is tapered on its left and right edges and is parallel to the longitudinal direction of the film tape. It includes the oblong elevations 32 thru 35 that contact the film tape in those areas of it which contain no position markings or characters. The lead plate is perforated opposite the opening 17*a* in the forward sidewall 17 in three places, by the openings 36, 37 and 38. Opening 36 is aligned with the two character rows 22 and 23. Opening 37 aligns with row 26 of the positioning marks, and opening 38 aligns with row 24 of the positioning marks.

The formation and arrangement of a roller is best recognizable in the left part of FIG. 3, in which roller 27 is partially shown in the longitudinal section. The formation and location of the second roller 29 corresponds to roller 27. Between the upper flange 29 and the lower flange 40 roller 27 has a graduated core whereby the core next to the flange are of a larger diameter then the middle area located in between. The core is equipped with a central bore 42. Roller 27 is built into the cassette in such a manner that the upper flange 39 is opposite the upper wall 4, whereas the lower flange 40 is adjacent to the floor 14. The roller is also kept in the position shown in FIG. 3 by attaching a disc 43 below the lower flange 40 whose diameter is somewhat smaller then the diameter of bore 16 in the floor, so that, the disc supports itself in the bore. The disc 43 is made of ferromagnetic material and forms part of a coupling which joins with the post 44 that is attached to the photocomposing machine itself. FIG. 3 further shows that only such parts of the film which do not have any marks or characters contact the roller.

In the version of the character holder as shown in FIGS. 2 and 3 the rollers 27 and 29 are loosely positioned in the cassette. Both rollers are pulled together through the influence of the pull from the film tape so that the film tape tension does not cause it to be stretched. Only when a cassette is inserted into the photocomposing machine, whereby rollers 27 and 29 are centered on the posts 44 and 45, which reach the cassette as shown in FIG. 4, are the rollers pulled apart to tighten the film, which for part of its length contacts the larger diameter sections of core 41 and rests smoothly on the elevations on lead plate 28. This also causes proper height centering of rollers 27 and 29 and film tape 21. Because the discs 43 are made of a ferromagnetic material the corresponding discs 46 and 47 on the photocomposing machine are also ferromagnetic. For exact centering of the character holder on the photocomposing machine there are provided centering posts 48 and 49 that protrude from the upper surface area of the photocomposing machine.

Finally, FIG. 4 also shows that a lighting prism protrudes through this surface area in such a manner as to reach through the opening 15 when the character holder cassette is affixed in place and serves to redirect the light path onto the film tape, whereby the character and marking rows 23 thru 26 are projected through the corresponding openings 36 thru 38 in lead plate 28, through opening 17*a* of the forward sidewall and into the photocomposing machine.

I claim:

1. A character holder for photocomposing machines having characters and position markings, comprising:

a cassette (3), two separately positioned rollers (27) and (29), and a continuous film tape (21) which leads around said rollers wherein, at least one of said rollers (27) and (29) includes a coupling part accessible from outside of said cassette for rotating said roller, and said one roller is loosely positioned in said cassette so that said one roller can be moved with respect to the other roller through said part to tension said film strip.

2. The character holder according to claim 1, wherein, said cassette (3) is formed as an oblong box, said film strip lead (21) is substantially parallel to two opposing sidewalls (17) and (18) of said box, and said cassette contains only one opening (17*a*) in said sidewall (17).

3. The character holder according to claim 2, wherein, said cassette contains an additional opening (15) in the floor (14) of said box.

4. The character holder acoording to claim 3, wherein:

each of said rollers (27) and (29) is equipped with an upper flange (39) and a lower flange (40), said upper flange (39) being located across an upper wall (4) of said cassette, said lower flange (40) being supported on the floor (14), said floor including a bore (16) which is somewhat smaller than the diameter of said lower flange (40), said lower flange including a disc-shaped part (43) made of ferromagnetic material having a diameter that is somewhat smaller than the diameter of said bore (16) in the floor, and said roller includes a coaxial interior bore (42) extending through said disc-shaped part.

5. The character holder according to claim 4, wherein, said roller includes a spool-shaped core (41) between said flanges (39) and (40), which contacts selected portions of the film tape (21).

6. The character holder according to claim 5, wherein, said floor (14) includes at least two cassette alignment holes (19) and (20).

7. A character holder for photocomposing machines having characters and position markings arranged by rows comprising:

a cassette (3), two separately positioned, rotating rollers (27) and (29) within said cassette, a continuous film tape (21) which leads around said rollers (27) and (29), said cassette being defined as an oblong box having two opposing sidewalls (17) and (18), said sidewall (17) including a first opening (17*a*), a lead plate (28) located in said cassette parallel and in close proximity to said sidewall (17) with said continuous film tape (21) passing between said plate and said sidewall (17), said plate (28) having at least one opening located across from said opening (17*a*), and at least one of said rollers is loosely positioned in said cassette and movable with respect to the other roller for tensioning said film strip around said rollers.

8. The character holder according to claim 7, wherein, said lead plate (28) includes a plurality of elevations oriented toward said sidewall (17) and contacting said film tape in the portion thereof not containing character or position markings.

9. The apparatus comprising, a cassette, a continuous film strip, at least two rollers rotationally mounted in said cassette, including means for engaging said rollers from outside the cassette, said strip passing around said rollers in contact with only selected portions of the strip surface and, each of said rollers being on a loose rotational axis within the cassette so that the rollers can be shifted to tension the strip.

10. The apparatus according to claim 9, further comprising: a lead plate within said cassette which includes means for contacting selected portions of the strip surface to properly align the loop as it is tensioned.

* * * * *